United States Patent [19]

Garland

[11] 4,140,221

[45] Feb. 20, 1979

[54] PUBLICATION DISPLAY RACK

[76] Inventor: Guy D. Garland, 5616 E. 2nd St., Long Beach, Calif. 90803

[21] Appl. No.: 799,256

[22] Filed: May 23, 1977

[51] Int. Cl.[2] ..... A47F 5/01

[52] U.S. Cl. ..... 211/58; 211/181; 211/184

[58] Field of Search ..... 211/58, 55, 56, 181, 211/106, 184, 112; 40/145 R, 124.1, 125 R; 220/19

[56] References Cited

U.S. PATENT DOCUMENTS

| | | | |
|---|---|---|---|
| 581,269 | 4/1897 | Coberley | 211/181 X |
| 736,879 | 8/1903 | Robinson | 211/55 |
| 854,994 | 5/1907 | Fack | 211/181 X |
| 929,714 | 8/1909 | Schlegel | 211/58 |
| 955,589 | 4/1910 | Fassio | 211/56 |
| 1,069,114 | 8/1913 | Crecelius | 211/50 |
| 1,715,078 | 5/1929 | Whyte et al. | 211/106 X |
| 3,043,441 | 7/1962 | Dumford | 211/181 X |
| 3,098,568 | 7/1963 | La Pierre | 211/181 X |
| 3,150,778 | 9/1964 | Gurian | 211/181 X |
| 3,995,744 | 12/1976 | Metcalf | 211/181 X |

*Primary Examiner*—James T. McCall
*Assistant Examiner*—Robert W. Gibson, Jr.
*Attorney, Agent, or Firm*—Fulwider, Patton, Rieber, Lee & Utecht

[57] ABSTRACT

A publication display rack is provided in which a plurality of wire baskets of uniform breadth are provided and are stacked in a vertical array at separated intervals to provide opposing pockets disposed in back to back relationship. Latching links are provided to extend from rear mounting bars forward for engagement with laterally extending cross bars parallel to the mounting bars. The latching links selectively subdivide the pockets in the baskets into subsections of ideal size to accomodate travel brochures such as are used in travel agencies. The display racks mount the travel brochures in overlapping fashion, but in a vertical arrangement to minimize the required floor space. End panels on the rack are provided for aesthetic appearance and the rack accomodates a sign mounted overhead. A plurality of racks may be mounted about a central upright pole in cantilever fashion to form a publication display.

12 Claims, 5 Drawing Figures

FIG. 1
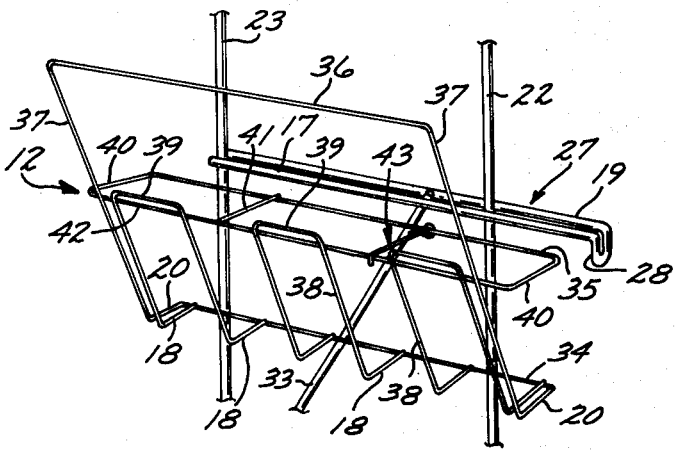
FIG. 2
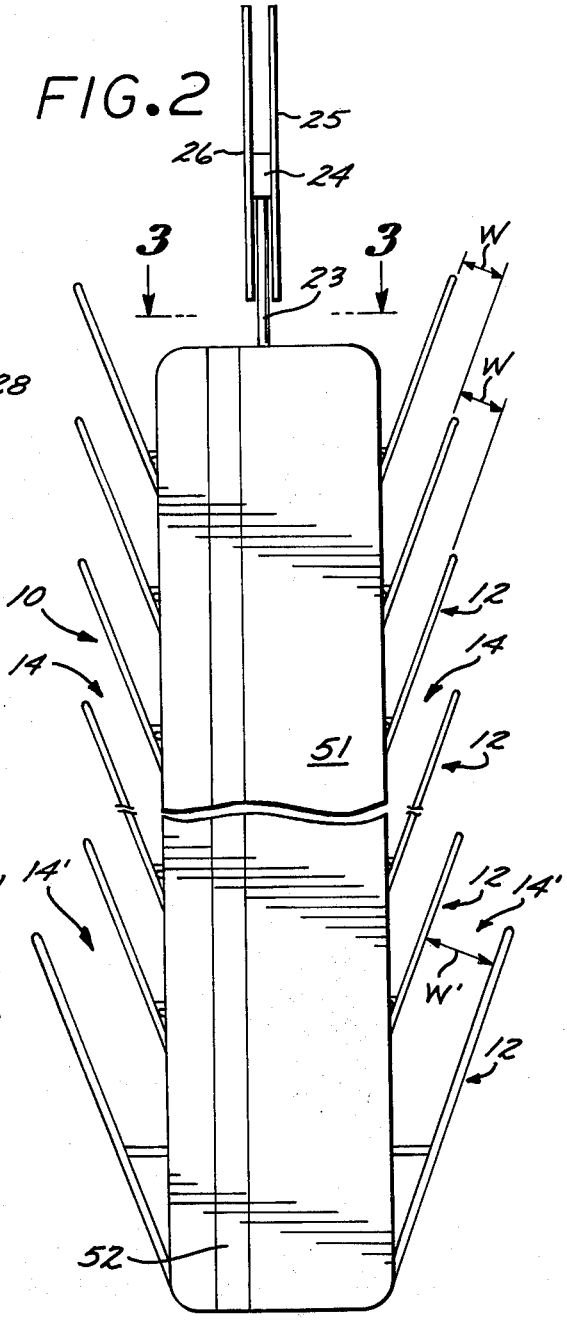
FIG. 3
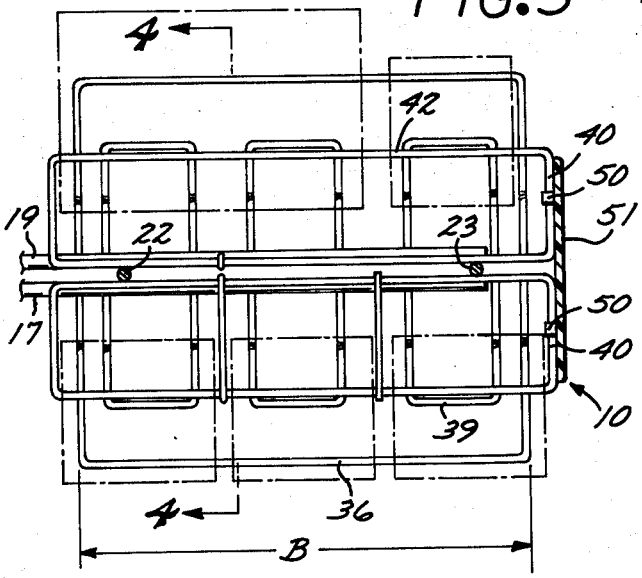
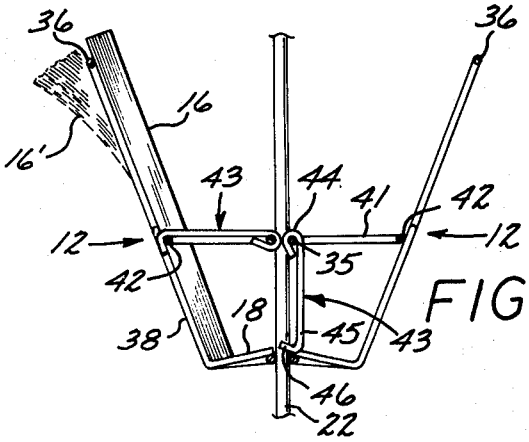
FIG. 4
FIG. 5
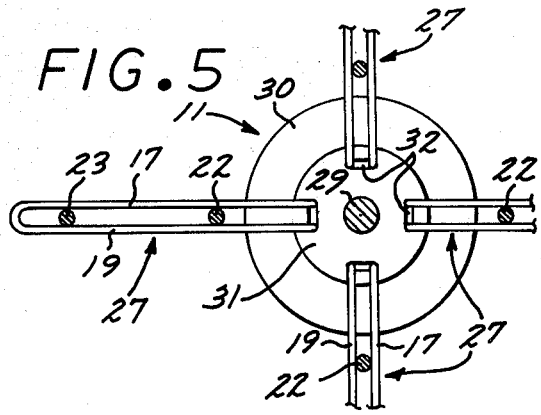

PUBLICATION DISPLAY RACK

FIELD OF THE INVENTION

The present invention relates to publication display racks and in particular to racks formed from cylindrical wire stock for displaying travel brochures.

BACKGROUND OF THE INVENTION

A considerable number of publication display racks have been developed over the years for the purpose of displaying printed material. Ideally, such racks allow a maximum amount of material to be displayed with a high degree of visiblity within a minimum amount of space. Heretofore, conventional display racks have attempted to provide visibility of the printed material to be displayed. One approach details displaying the faces of publications in their entirety in a vertical arrangement, thus allowing the display of only a limited number of publications within a vertical array. Another approach is to effectuate display of a plurality of publications in a pyramiding fashion, but a considerable amount of floor area is required for such an arrangement.

Another deficiency of conventional publication display racks is that they have heretofore been formed with rigid unalterable dimensions so that publications of but a single size can be properly displayed. While this presents no real problem in displaying recurring publications, for example, magazines which appear month to month and are always of the same size, or paperback books which are by and large of a single uniform size, the inflexiblity of conventional display racks is quite disadvantageous in displaying other publications. For example, travel agencies periodically receive travel brochures, published mainly by tour chartering agencies. Such brochures typically come in two different standard sizes, specifically 8½ inches by 11 inches and 4 inches by 9 inches. However, the relative quantities of brochures of each of these two standard sizes varies considerably at any given time. Moreover, different travel agents are attracted to different types of brochures so that the mix of the two different standard sizes of brochures varies considerably from one travel agency to another. With existing travel brochure display racks, the racks are either dimensioned to accomodate but a single size, or they are dimensioned to accomodate the larger 8½ by 11 inch size. In the former instance, there is no flexibility insofar as accomodating different mixes of the various sizes of brochures using display racks of conventional manufacture. In the latter instance, the 4 by 9 inch brochures tend to fall sideways and present a disorderly and unslightly appearance.

It is an object of the present invention to provide a versitile travel brochure display rack formed by an array of open display baskets of uniform breadth and arranged in vertical displacement one from another in overlapping fashion. The arrangement of the baskets nested in vertical alignment allows display pockets to be formed disposed at a uniform angle of inclination relative to the vertical in the vertical areas of overlap adjacent baskets. With the exception of the lowermost basket, the baskets are all formed of uniform dimensions which both aids in their manufacture and which allows a display to be created which is of generally rectilinear outline, and which is not formed in a pyramid type arrangement. This represents a considerable saving in floor space, especially in travel agency offices which are frequently quite small and usually entail a considerably high rental on a square footage basis. Moreover, by avoiding the pyramid style of construction in which display pockets are arranged in a narrowing pattern proceeding from the bottom of the display rack to the top, visiblity and accessiblity of the brochures is considerably enhanced. With conventional pyramiding type racks, an interested person is forced to view the uppermost publication in the rack from a distance and hence is likely to lose interest quickly in reading any of the brochures unless he notices a brochure that particularly appeals to him. By utilizing the display rack of the present invention, on the other hand, an interested person can move quite close to the upper display pockets, which he is most likely to notice since they are approximately at eye level. The ease of access to these upper brochures and the facility with which they may be read while still in the rack serves to enhance the interest of observers and thus capture their attention longer.

An additional advantage of the improved travel brochure display is that the vertical alignment of display pockets allows a plurality of racks to be mounted on radial arms extending outward from a center pole in an arrangement which can be rotated as on a turntable or lazy susan. This provides a publication display formed of several racks which can be easily manipulated for viewing and which occupy but a small area of floor space. Such an array of rotatable racks is virtually impossible with conventional racks in which brochures are arranged in pyramiding fashion.

A further object of the invention is to provide a rack for displaying travel brochures which is adjustable to accommodate virtually any different mix of brochure sizes. The present invention employs latching links which are rotatably connected to horizontal mounting bars at the rear of each wire basket. These latching links, unless engaged, hang downward in an unobtrusive fashion so that the larger brochures can be positioned in the pockets and read by passing observers without obstruction from the links. On the other hand, the latching links can be rotated up and forward into generally horizontal alignment to extend outward and engage a front cross bar of the brochure pocket. This serves to subdivide the pocket into a plurality of sections of smaller size, so that the narrower brochures can be positioned therein without continually falling sideways. The latching link can be engaged or released depending upon whether the pocket is required for the display of large or of small brochures.

Still another object of the invention is to provide an upward forward support for the upper edge of publications positioned in the pockets. Unlike thicker publications, travel brochures consist of only a few folded sheets of paper. Consequently, after remaining on a rack for more than about a week the upper portion of the brochure begins to collapse and sag forward. This causes the banner lettering, usually imprinted across the upper portion of the brochure to be obscured and presents a displeasing appearance since instead of the banner lettering, the spreading upper edges of the pages of the brochure are presented for observation. By employing the upper edge support of this wire according to the present invention, the banner lettering of the brochures remains visible while the upper edges of the publications are supported.

A further feature of the improved display rack of the invention lies in the construction which provides a pair of spaced vertical standards upon which the baskets are mounted in horizontal orientation. Besides providing support for the baskets, the vertical standards have other utility because their ends protrude above the baskets and serve as posts upon which an upright sign can be mounted. Such a sign can be used to designate the particular area of the world to which brochures in the rack relate, or they can serve as a source of advertising for particular travel chartering firms, airlines, cruise lines and the like. Moreover, the sign can be concurrently employed both to provide information as well as to serve as an advertising medium.

An additional object of a perferred form of the invention involves a decorative end panel which can be clippped into position on the rack to extend vertically along the sides of the baskets to conceal the unslightly edges of the travel brochures which would otherwise be visible.

A further feature of the invention is that the releasable latching links which are used to separate the basket pockets into sections are in generally horizontal alignment with the bottom rail supports of the pocket located thereabove. Thus, the latching links do not interfere with the upward extension of any of the travel brochures, but rather merely augment the lower supports provided to the brochures in the pocket above.

DESCRIPTION OF THE DRAWINGS

FIG. 1 is a perspective view showing attachment of a basket of the display rack to vertical standards.

FIG. 2 is an edge view of the display rack of the invention.

FIG. 3 is a plan view taken along the lines 3—3 of FIG. 2.

FIG. 4 is an enlarged sectional view of a pair of opposing baskets taken along the lines 4—4 of FIG. 3.

FIG. 5 is a plan view illustrating mounting of the display rack in a publication display.

DESCRIPTION OF THE EMBODIMENT

Referring in particular to FIGS. 2 and 3, a stand 10 is depicted for displaying printed material. The stand 10 is constructed of a framework of wire bar stock bent through a variety of curves and formed into various configurations and spot welded at areas of contact to form an array of upwardly and outwardly inclined display baskets 12 and 12'. The display baskets 12 are depicted in detail in FIGS. 1 and 4 and are of a uniform breadth indicated between the dimension lines denoted B in FIG. 3. All of the baskets are of uniform width except for the lowermost basket 12', which is of greater width. The widths of the pockets 14 between baskets is thus a uniform width W, preferably a dimension of 1½ inches, as indicated in FIG. 2 except for the lowermost pocket 14', which is of a greater width W', preferably 2 inches. This greater pocket width is due to the greater width of the lowermost basket 14'. Such a larger bottom pocket is highly advantageous because it forms a convenient display location for travel catalogues and thicker travel brochure material which is inadequately accomodated by the standard 1½ inch width of a travel brochure display pocket in conventional travel brochure display racks.

It should also be noted that the pocket width of the uppermost basket 12 is considerably larger than the width W. This is because this uppermost pocket is not bounded by two vertically spaced baskets as are the other pockets, but rather is bounded by the distance between the upper basket intermediate mounting bar 35 and the upper basket forward cross bar 42 depicted in FIG. 3, which structural elements will be, described hereinafter in greater detail. The uppermost pocket is preferably three inches in width and is used to accomodate the most popular travel brochures.

The baskets 12 are arranged in vertical displacement one from another in nested fashion in upright vertically oriented arrays as depicted in FIG. 2. As can be seen in FIG. 2, the baskets are positioned at overlapping vertically spaced intervals so that the upper extremity of each basket extends above the horizontal level of the lower extremity of the basket located above and immediately adjacent thereabove.

Pockets 14 are formed between adjacent baskets to accomodate a supply of travel brochures depicted, for example, at 16 in FIG. 4. As can be seen in FIG. 2, the pockets 14 are positioned to form a pair of vertically aligned arrays disposed in back-to-back relationship. The forward extremities of the pockets formed by the bent wire rails 18 and 20 are inclined upwardly and outwardly in overlapping fashion to hold the travel brochures 16 at a relatively small angle with respect to the vertical, so that they may be easily read, but at an inclination sufficient to allow the baskets 12 to be stacked one above the other in nested fashion so that the brochures in vertically adjacent pockets partially overlap. The angle of inclination of all of the baskets 12 is uniform. The feature of overlapping is desireable in that it allows a considerably greater number of brochures to be compactly positioned for display in a limited area, and is of no great disadvantage in connection with travel brochures, as the banner lettering imprinted across the upper portion of each brochure is still clearly visible.

The publication display rack 10 is constructed about a pair of vertical steel rods 22 and 23 which extend from the bottom of the lowermost basket 12 upperward about 3 inches above the uppermost basket 12. The upper extremities of the rods 22 and 23 serve as posts which receive sleeve-like caps 24, having downwardly facing open ends and enclosed upper ends. The caps 24 are fastened between a pair of parallel thin display panels 25 and 26 upon which advertising material or geographic or other information is imprinted. The caps 24 are spaced apart the same distance as are the posts 22 and 23 so that the display panels 25 and 26 are easily positioned and removed as a unit from the publication display rack 10.

Extending horizontally and transversely across the vertical rods 22 and 23 are upper and lower lengths of steel bar stock, each of which is bent back upon itself roughly in half and welded at the ends on either side of the rod 23 to form transverse structures 27 serving as cross braces and cantilever mounting arms. The structure 27 passes as a cross brace 17 from the rod 23 in parallel lengths past the rod 22 and is welded thereto on either side as depicted in FIG. 1. The structure 27 extends beyond the upright rod 22 to form a cantilever arm 19 which is turned downward at its longitudinal extremity in a short loop 28. A plurality of cantilever arms 19 arranged in vertically displaced pairs near the upper and lower portions of each of the display racks 10 are used to hold a plurality of display racks 10 a short distance from a vertical pole 29 rising from a stabilizing base or stand 30 to form a publication display 9 as depicted in FIG. 5. The pole 29 carries a pair of disk shaped annular mounting brackets 32 with oblong perforations 32 defined about the perimeter thereof at equally spaced intervals. The mounting brackets 31 are arranged in vertical alignment on the pole 29 with the perforations 32 likewise aligned so that the mounting brackets 31 receive the upper and lower cantilever arms 19 of each display rack 10 with the downwardly turned loops 28 passing through the apertures 32 therein so that the mounting brackets 31 carry a plurality of display racks 10. In FIG. 5, the mounting brackets 31 are illustrated as carrying four sets of cantilever arms 19 to carry four corresponding mounting racks 10. As is apparent from FIG. 5, any particular pair of cantilever arms 19 may be lifted from the mounting brackets 31 to remove the display rack associated therewith from the central vertical pole 29. Preferably, the mounting brackets 31 rotate on ball bearings relative to the center pole 29 so that the display racks 10 can be moved together in an orbit about the vertical pole 29 in a lazy susan arrangement to form a publication display 11 having a plurality of display racks 10.

As can be seen in FIG. 1, a diagonal stiffening brace 33 formed of steel bar stock interconnects the upper and lower cross braces 17 associated with each display rack 10. Each of the baskets 12 is formed with a lower mounting bar 34 and with an intermediate mounting bar 35 parallel to and located approximately 3 inches above the lower mounting bar 34. Both the lower mounting bar 34 and the intermediate mounting bar 35 extend transversely across and are welded to the vertical dividing rods 22 and 23. At the edge extremities of the basket 12, the lower mounting bars 34 curve and turn outward away from the vertical rods 22 and 23 inclined downwardly at a slight angle to travel as short edge rails 20 a distance of about 1¾ inches as depicted in FIG. 1. The edge rails 20 turn upward at an incline as framing rails 37 a distance of some 8⅝ inches whereupon the bar stock is again curved and extends horizontally inward parallel to the lower mounting bar portion 34 to provide an upper forward support 36 for the upper edges of publications positioned in the pockets 14 of the baskets 12.

Located between the edge rails 20 are three separate lengths of steel wire each formed generally in the shape of an inverted U with legs 38 extending at an incline parallel to the framing rails 37 and with the lower extremities of the legs 38 turned perpendicularly inward to form the bottom support rails 18. The ends of each of these three segments of wire are welded to the lower mounting bar 34. The upper horizontal portion of each of the inverted U-shaped lengths of wire extends laterally to form an intermediate brochure support 39.

The intermediate mounting bar 35 is but a portion of a single endless loop of steel wire and from the edge extremities turns outward horizontally to form side retaining rails 40. The wire then turns parallel to the intermediate mounting bar 35 and extends as a forward cross bar 42 across interior surfaces of contact with the legs 38 which are welded thereto. Thus, an openwork basket framework is formed which will support a supply of publications 16 located therein. Horizontal fore and aft dividers 41 are provided to extend from the intermediate mounting bar 35 to the forward cross bar 42. The fore and aft dividers 41 thereby divide the pockets 14 into laterally adjacent sections. The left hand section so formed in FIGS. 1 and 3 is of a breadth slightly greater than four inches, leaving the breadth of the adjacent section slightly greater than 8 inches in the absence of any subdivision thereof.

The sections of the pockets 14 may be subdivided by latching links 43. A single latching link 43 is provided in association with each intermediate mounting bar 35. Each latching link 43 is constructed with eye 44 at one end thereof encircling the associated intermediate mounting bar 35. From the eye 44 the latching link 43 extends in a shank 45 which terminates in a hook 46. The latching link 43 is arranged so that the shank 45 may be positioned to pass over the forward cross bar 42 with the hook 46 passing thereover and extending downward a short distance. A latching link 43 is depicted in a postion engaged about the forward cross bar 42 in the left hand basket 12 of FIG. 4. When in this position, the latching link 43 divides the larger section of the pocket 14 into two subsections, each subsection so formed having a breadth of slightly in excess of four inches.

A further feature of the latching link 43 is that it is in general horizontal alignment with the bottom rails 18 of the pocket 14 formed by the basket 12 located above the latching link when the latching link 43 is engaged with a cross bar 42. This feature is best depicted in the lower portion of FIG. 2. In this manner, the bottom rails 18 and the latching link 43 form a level bottom support for publications inserted in each pocket 14.

A relatively thin vertical black acrylic strip 51 with a one inch wide vertical chrome stripe 49 thereon is provided to mask the edges of the publications 16 located in the pockets 14 as depicted in FIG. 2. The chrome stripe 49 is provided for decorative purposes. The vertical masking strip 51 is fastened to spaced ones of the edge restraining rails 40 by plastic or rubber blocks 50 glued to the masking strip 51 with lateral grooves thereon designed to snap onto and clasp several of the edge restraining rails 40 of different baskets. The mask 51 thereby renders the display rack 10 more attractive in appearance and abscures the edges of the travel brochures 16 from view to a large extent.

A principal feature of the invention is the flexibility to alter the size of the sections of the pockets 14. The sections may be expanded by merely lifting the latching link 43 from engagement with the cross bar 42 from the position depicted in the left hand portion of FIG. 4, and letting the latch link 43 drop to the position depicted in the right hand portion of FIG. 4. Thus, a section of the pocket 14 is formed which is slightly in excess of 8½ inches in width and which thereby accomodates the standard 8½ by 11 inch size of travel brochure. To alter the same section of the same basket 12 to accomodate the other standard 4 by 9 inch size travel brochure, one merely lifts the hook 46 of the latching link 43 and rotates the latching link 43 upward from the position indicated in the right hand portion of FIG. 4 about the intermediate mounting bar 35 bringing the hook 46 into engagement with the forward cross bar 42. In this position, the position of the latching link 43 in the left hand basket of FIG. 4, the larger section of the pocket 14 is divided into subsections, each slightly in excess of four inches in width. Thus, each pocket 14 may be altered to accomodate either three standard 4 inch by 9 inch travel brochures positioned side by side or alternatively, a 4 inch by 9 inch travel brochure positioned next to a standard 8½ inch by 11 inch travel brochure.

The function of the upper forward support bar 36 should also be noted. As depicted in FIG. 4, the upper support bar 36 provides lateral support for the upper extremities of the publications 16 positioned in the pockets 14 of the baskets 12. Without the upper support bar 36, the publication 16, after remaining on the rack for several days, would tend to sag forward to the position 16' depicted in dotted lines in FIG. 4. However, by providing the upper forward support bar 36 this undesireable sagging is avoided. Since the upper forward support bar 36 is located 8½ inches from the forward extremities of the edge rails 20, it provides support at the very upper edge of the standard 4 inch by 9 inch travel brochure. Likewise, it provides support at a maximum of 2½ inches below the upper edge of the conventional 8½ by 11 inch size travel brochure.

As previously noted, and is best depicted in FIG. 2, the widths of the baskets 12 is uniform, and all of the baskets 12 and 12' are aligned in vertical arrays and the pockets 14 and 14' are arranged in overlapping fashion. Thus, the pyramiding effect found in so many display racks is avoided and the uppermost travel brochure are easily accessible and readable. Moreover, by overlapping the pockets 14 and 14', a considerable number of different travel brochures can be arranged in a single display rack 10. Preferably, the travel rack 10 comprises 11 vertical levels of baskets positioned one above the other in the manner depicted in FIG. 2.

Undoubtedly various modifications and alterations of the present invention will become apparent to those familar with travel brochure display racks. Accordingly, the present invention should not be limited to the single embodiment depicted herein, but rather is defined by the claims of the invention appended hereto.

I claim:

1. A stand for displaying printing material comprising a wire framework forming an array of open display baskets arranged in vertical displacement one from another in overlapping fashion, each basket having upwardly and forwarding inclined framing rails and a transverse upper forward support rail extending between said framing rails, and intermediate transverse crossbar extending between said framing rails and below said transverse upper forward support rail, an intermediate lateral mounting bar located to the rear of said immediate transverse crossbar in horizontal displacement therefrom and associated therewith, the structure further comprising fore and aft dividers extending between said associated mounting bars and cross bars to define laterally adjacent pocket sections, wherein at least some of said dividers are releasable latch links rotatably mounted upon ones of said intermediate mounting bars at one of their ends and with hooks at their opposite ends, and each of said latch links is positionable to pass over and latch the intermediate transverse crossbar associated with the mounting bar upon which it is rotatably mounted, and wherein transverse upper forward support rails of said baskets are in vertical alignment with each other, whereby ones of said pockets in said baskets are vertically aligned one above the other.

2. The stand of claim 1 further comprising central upright support means and further characterized in that said baskets are constructed with lower lateral rear mounting bars, and said baskets are attached to said upright support means by said lower and intermediate mounting bars.

3. The stand of claim 1 further characterized in that releasable latch links are each constructed with an eye at one end circling one of said intermediate rear mounting bars, and a hook at the opposing end which may be positioned to pass horizontally over and to latch to a forwardly located and associated transverse crossbar.

4. The stand of claim 1 further characterized in that each of said pockets is formed with parallel bottom rails spaced laterally at intervals of less than four inches and extending outwardly away from the rear of said pocket, and each latch link is generally in horizontal alignment with the bottom rails of the pocket above when engaged with a cross bar, whereby said bottom rails and said latch link form a level bottom support for printed material inserted in pockets thereabove.

5. The stand of claim 1 further characterized in that at least one of said sections in each basket so formed is at least 4 inches in breadth and another of said sections so formed is at least 8½ inches in breadth and is divided into two subsections by engagement of said latching link with said forward cross bar, each subsection so formed being at least four inches in breadth.

6. A publication display rack comprising a plurality of vertically aligned wire baskets positioned in nested fashion at vertically spaced intervals in an upright array to form opposing pockets disposed back to back and in mutual vertical alignment with other pockets wherein the forward extremities of said pockets are forwardly inclined framing rails extending in overlapping fashion at a uniform angle to the vertical, and each basket includes a transverse upper forward support rail extending between said framing rails, an intermediate transverse crossbar extending between said framing rails, below said upper forward support rail, an intermediate lateral mounting bar located directly to the rear of an associated transverse crossbar, and fore and aft dividers, wherein at least some of said fore and aft dividers are releasable latch links rotatably mounted upon ones of said intermediate mounting bars and have hooks releasably positionable to pass over and latch the intermediate transverse crossbar associated with the mounting bar upon which they are rotatably mounted, and wherein transverse upward forward support rails of said baskets are in vertical alignment with each other.

7. The publication display rack of claim 6 further characterized in that each of said pockets is constructed with a plurality of bottom rails extending outwardly away from the opposing pocket to form bottom supports for publications positioned thereon, and front support rails rise from said bottom rails to provide forward support for said publications, and the outermost of said forward support rails at the lateral extremities of each pocket are turned upward to form said framing rails which at their upper extremities turn horizontally inward toward each other to define said transverse upward forward support rails for the upper edges of publications positioned in the pockets of said baskets.

8. The publication display rack of claim 6 further characterized in that said upper forward support rail is spaced approximately 8½ inches from the forward extremities of said bottom rails.

9. The publication display rack of claim 6 further characterized in that a vertical laminar end mask is provided and is attached to ones of said baskets to conceal at least a portion of the ends of said baskets.

10. The publication display rack of claim 6 further comprising upright vertical standards upon which said baskets are mounted, wherein said standards extend above the uppermost of said baskets and further comprising a vertically oriented sign with connecting sleeves for mounting on said upright standards, whereby said sign is mounted atop said array of baskets.

11. A publication display comprising a vertical pole rising from a stand and carrying a plurality of mounting brackets at vertically spaced intervals, a plurality of cantilever arms extending radially outward from said pole and attached in vertical alignment to said mounting brackets, and a plurality of display stands for printed matter each supported by vertically aligned ones of said cantilever arms, each stand comprising a wire framework formed of a pair of radially spaced vertical dividers and a plurality of wire baskets supported in horizontally aligned pairs on either side of said vertical dividers with pairs of said baskets vertically spaced from each other in overlapping fashion, thereby forming a pair of arrays of vertically aligned pockets with said pockets disposed at a uniform angle of inclination relative to the vertical with said arrays arranged in back to back relationship.

12. The publication display of claim 11 further characterized in that said cantilever arms are permanently secured to said stands and removably attached to said mounting brackets.

* * * * *